US006042522A

United States Patent [19]

Farenholtz

[11] Patent Number: 6,042,522

[45] Date of Patent: Mar. 28, 2000

[54] MOUNTING AND RELEASE MECHANISM FOR A MANNEQUIN

[75] Inventor: Douglas William Farenholtz, Abbotsford, Canada

[73] Assignee: Medical Plastics Laboratory, Inc., Gatesville, Tex.

[21] Appl. No.: 09/185,958

[22] Filed: Nov. 5, 1998

[51] Int. Cl.[7] ..... F16C 11/00

[52] U.S. Cl. ..... 482/83; 446/383

[58] Field of Search ..... 482/83–90; 223/66–68, 223/85, 93, 94; 446/373–384, 330

[56] References Cited

U.S. PATENT DOCUMENTS

| | | | |
|---|---|---|---|
| 526,667 | 9/1894 | Schultz . | |
| 654,051 | 7/1900 | Brown et al. . | |
| 817,511 | 4/1906 | Palmenberg . | |
| 2,617,671 | 11/1952 | Barrango . | |
| 2,913,245 | 11/1959 | Landis . | |
| 3,357,610 | 12/1967 | Quinby, Jr. . | |
| 3,861,676 | 1/1975 | Paul . | |
| 4,139,193 | 2/1979 | Felber et al. . | |
| 4,545,514 | 10/1985 | Toy . | |
| 4,623,318 | 11/1986 | Tsiknopoulos | 446/330 |
| 4,630,762 | 12/1986 | Stringer . | |
| 4,673,374 | 6/1987 | Kelley | 446/383 |
| 4,964,629 | 10/1990 | Wirght | 482/83 |
| 5,180,086 | 1/1993 | Ikeda . | |
| 5,630,745 | 5/1997 | Yeh . | |
| 5,700,230 | 12/1997 | Cardona . | |

*Primary Examiner*—Glenn E. Richman
*Attorney, Agent, or Firm*—Merek & Voorhees

[57] ABSTRACT

A releasable connecting member for a mannequin having a resiliently deformable first contact member with a contact area, connected to one of a support end and object attachment end, and a second contact member, connected to the other of the support end and object attachment end, contacting the contact area. The first contact member includes an adjuster for adjusting the mass of the first contact member in the contact area. The force required to overcome the contact force between the contact area and the second contact member is increased or decreased with a corresponding increase or decrease of mass of the first contact member at the contact area by the adjuster.

28 Claims, 12 Drawing Sheets

MOUNTING AND RELEASE MECHANISM FOR A MANNEQUIN

BACKGROUND OF THE INVENTION

1. Field of the Invention

The present invention relates generally to a releasable connecting mechanism for a mannequin, and more particularly to a mounting and release mechanism comprising a resiliently deformable ball contacting a cam with the force required to release the ball from the cam being adjustable by adjusting the mass of the ball in contact with the cam.

2. Description of the Prior Art

Mannequins or other targets (including handles, manual gripping members and the like) are utilized in the physical training and testing marketplace to provide a target for application of force by a user against a resisting force. The force applied by a user may be measured in order to determine the strength of the user in applying force against that target in a particular manner. This permits strength measurements to be taken and compared to predetermined threshold levels required for undertaking certain tasks required of the person being tested. This enables objective testing criteria to be established for various occupations requiring a certain minimum level of physical strength for performing tasks associated with that occupation. Mannequins and other targets may also be used as a part of an exercise regime to assist users in strengthening muscles used in performing tasks associated with particular occupations or as otherwise desired.

In the past these mannequins or targets have been connected to a resistance such as a weight stack to provide different pre-determined levels of force required for movement about an axis of rotation. However, more of these prior art mechanisms provide a mannequin or other target which incorporate two components releasably connected together which releases those components from a secured position for movement to an unsecured position on application of a pre-determined level of force. There is also no provision of such a mannequin or other target in which the pre-determined release force may be readily adjusted by a user.

U.S. Pat. No. 2,913,245 (P. H. Landis), discloses an athletic tackling bag which is hingedly connected to the ground. A fluid cylinder and spring is used to provide resisting force against lateral force applied to the athletic tackling bag. The resisting force can be adjusted by varying the air pressure in a fluid cylinder. Once a pre-determined force is reached a mechanism is activated to return the bag to its upright position. The Landis athletic tackling bag is a relatively large and cumbersome mechanism for providing an adjustable resisting force, not particularly suited to be contained within a mannequin or other target, provides a spring resistance for return of the target to its pre-release position on application of the pre-determined force.

As a consequence, there is a need for a mounting and release mechanism for attaching an object like a mannequin or similar target to a support or for attaching components of a mannequin together which are releasable from a connected position on application of a pre-determined amount of force. That attachment member may be located within the mannequin or target and be readily adjusted to vary the force required in order to release the object from a connected position with the support or to release components from connection to each other.

BRIEF SUMMARY OF INVENTION

The present invention provides a mounting and release mechanism which retains two components in a connected position until application of a pre-determined force on one of the components which causes the release of the mechanism and the separation of those components.

For example, a mannequin may be mounted at the mannequin torso to a support structure. Upon a predetermined application of force the mounting and release mechanism of the present invention, the mannequin may be made to move in a backward direction simulating a police officer's pushing action on a subject to restrain that subject. That mannequin may then be employed to measure the force applied to the mannequin by police officer trainees in order to determine whether or not those trainees meet predetermined, objective, physical standards necessary for employment as a police officer.

The present invention provides an attachment member for attaching an object to a support which includes a support end for supporting the member and the object and an object attachment end for attaching the object to the member. A connecting device for connecting the support end and object attachment end of the attachment member includes a resiliently deformable first contact member having a contact area connected to one of the support ends and object attachment end. The first contact member rotates about a first rotation axis and is deformable about its periphery to increase and decrease the mass of the first contact area at a contact area. The connecting means also includes an adjuster for increasing and decreasing the first contact member mass at the contact area and a second contact member connected to the other of the support end and attachment end contacting the contact area to releasably secure the support end to the attachment end. The force required to overcome the contact force between the first and second contact members permitting the first contact member to pass beyond the second contact member and rotate about the first pivot axis, increases and decreases with a corresponding increase and decrease in the mass of the fist contact member at the contact area.

Optionally, the mass of the first contact member at the contact area is increased and decreased as force is increased or decreased on the first contact member in first and second directions substantially perpendicular to the plane defined by the contact area and wherein the adjuster comprises a force applicator for increasing and decreasing the force on the first contact member in the first and second directions.

As a further option, the first and second directions can pass through the center point of the first contact member.

The attachment member can further include a pair of opposed parallel spaced contact members defining an indented portion between the contact members for receiving the sphere. The sphere may be rotated about the first rotation axis in either direction to overcome the contact force to permit the sphere to pass beyond one of the contact members and rotate about the first rotation axis.

In a further embodiment of the invention a conical release mechanism is connected to the support end for releasably attaching the attachment member to the support.

In yet a further embodiment of the invention a testing and training apparatus includes a resiliently deformable first contact member having a first contact area, the first contact member deformable about its periphery to increase and decrease the mass of the first contact member at the first contact area. A rotatable frame member is connected to the first contact member and is rotatable about an axis of rotation. An adjuster increases and decreases the first contact member mass at the contact area. The second contact member includes a plurality of apexes for contacting the contact area, the apexes in concentric circular alignment about the axis of rotation of the frame member and in alignment with the first contact area. The force required to overcome the contact force between the first contact member and each apex, permitting the first contact member to pass beyond each apex and rotate to the next aligned apex increases and decreases with a corresponding increase and decrease in the mass of the first contact member at the first contact area.

DETAILED DESCRIPTION OF THE PREFERRED EMBODIMENTS

Figure 1:
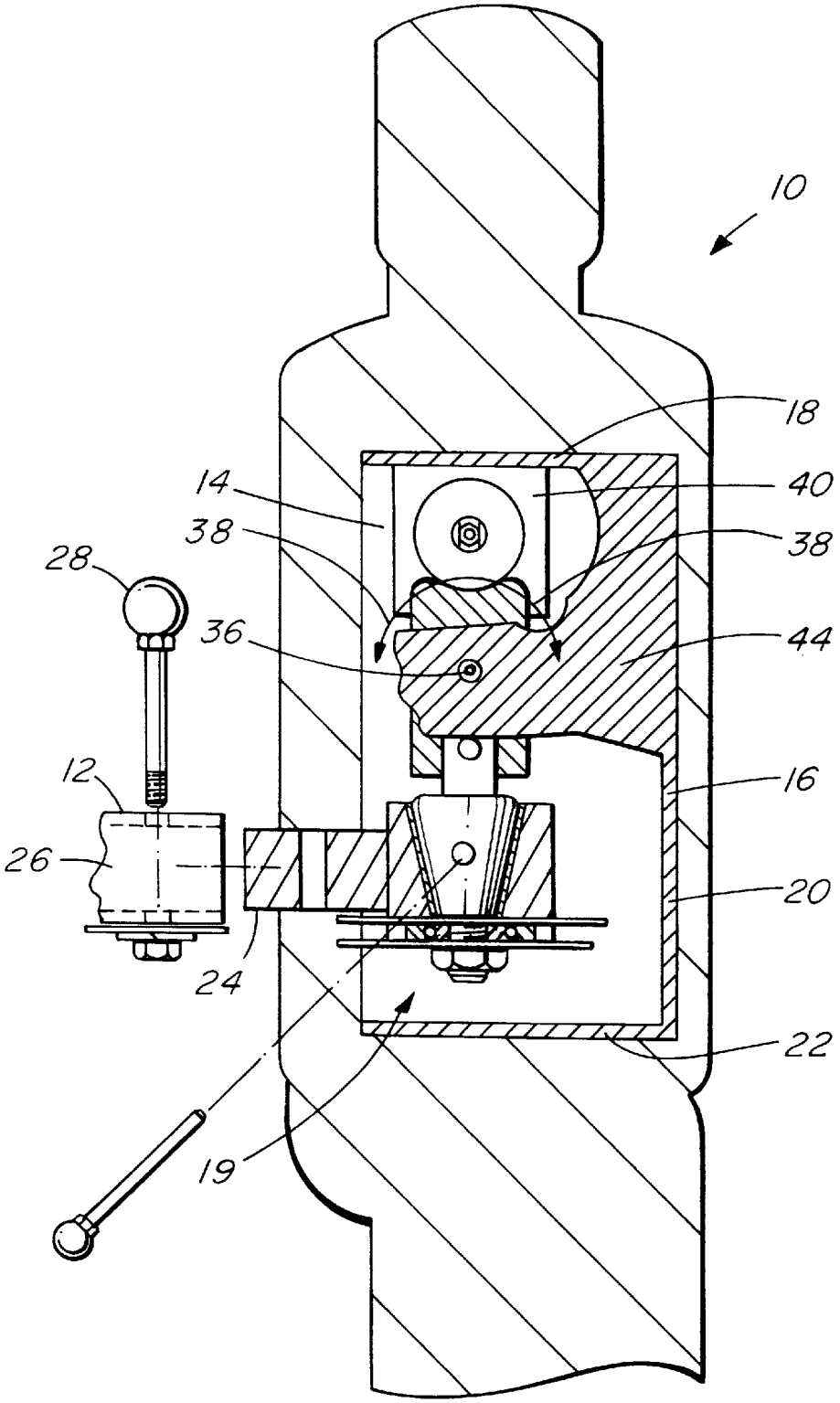
FIG. 1 is a schematic side view of a mannequin showing the ball and cam mounting and release mechanism in the secured position, according to a preferred embodiment of the invention.
Figure 2:
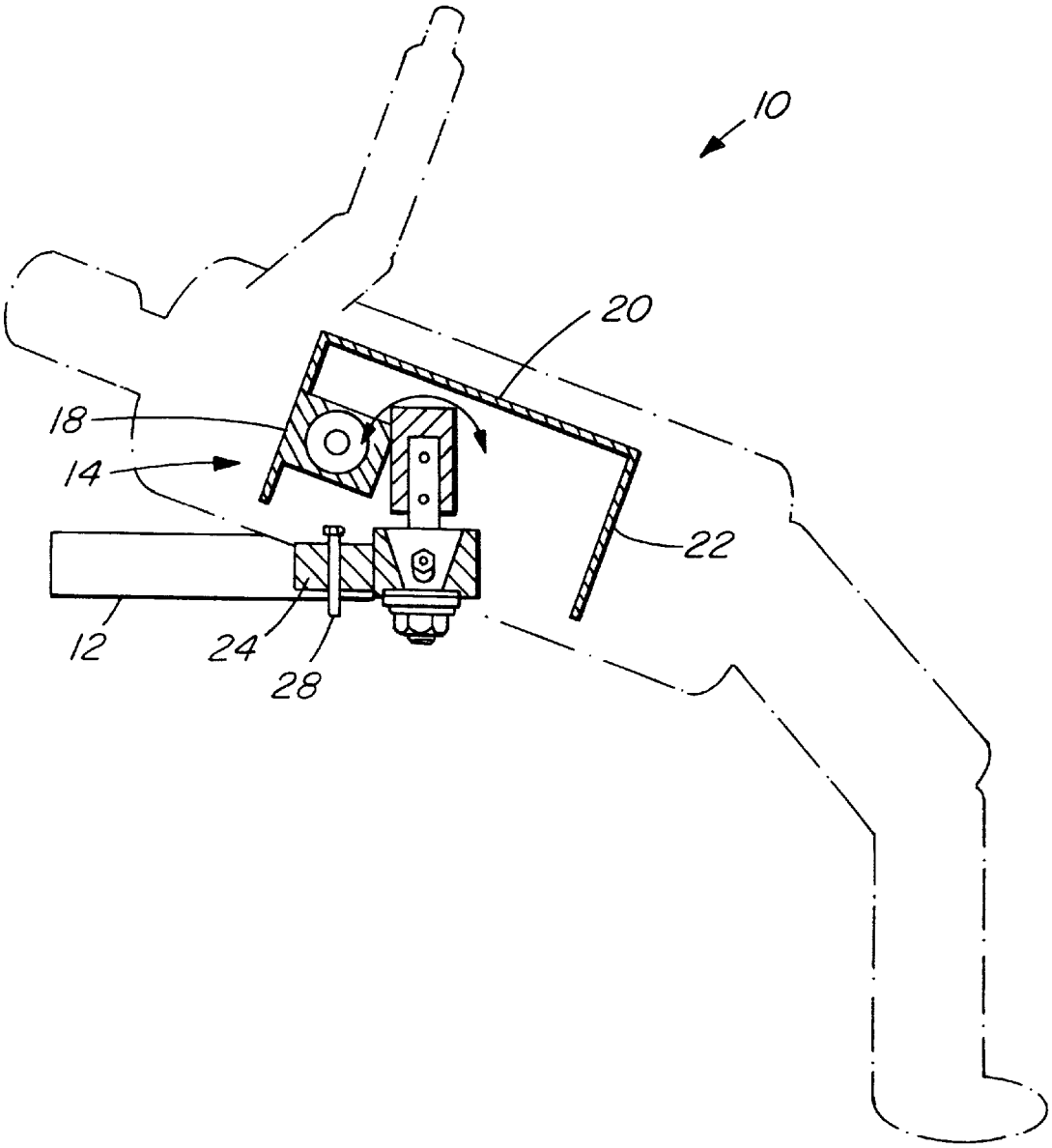
FIG. 2 is a side view of the mannequin showing the ball and cam mounting and release mechanism of the embodiment of FIG. 1, in a released position.

Referring to FIG. 1, a testing and training mannequin 10 is shown mounted to support beam 12 by means of ball and cam mounting and release mechanism 14. FIG. 1 shows mannequin 10 in its secured position, whereas FIG. 2 shows mannequin 10 in a released position following application of force exceeding a pre-determined force level on mannequin 10. While not shown, it should be understood that a rear portion of mannequin 10 through which support beam 12 and support flange 24 extend into mannequin 10, includes an opening of sufficient dimension to permit rotation of mannequin 10 about support beam 12 and flange 24 to the release position depicted in FIG. 2.

Mechanism 14 includes housing 16, including top plate 18, front plate 20 and lower plate 22. Plates 18, 20 and 22 are rigidly attached to an inner cavity 19 of mannequin 10 to rigidly attach a portion of mechanism 14 as described in greater detail below.

Figure 3:
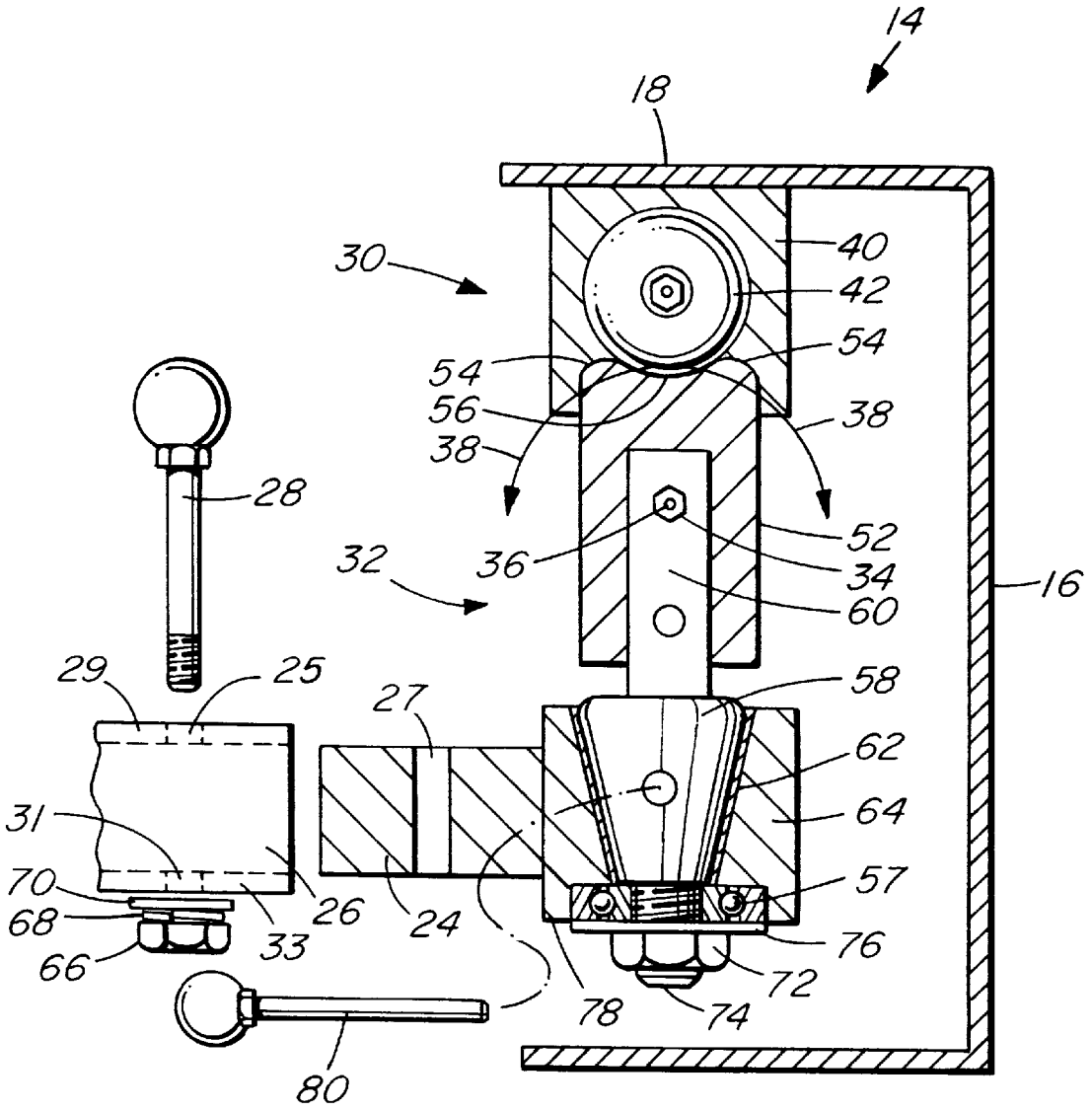
FIG. 3 is a close-up side view of the ball and cam release mechanism of the embodiment of FIG. 1, in the secured position.

Mechanism 14 also includes support flange 24 extending horizontally from mechanism 14 and dimensioned to fit within cavity 26 formed in the outer end of beam 12. As seen in FIG. 3, pin 28 extending through hole 25 in upper plate 29, hole 27 in flange 24 and hole 31 in lower plate 33 rigidly and releasably attaches flange 24 to beam 12 thereby releasably attaching mechanism 14, and mannequin 10 to support beam 12. Support beam 12 is, in turn, connected to a support structure such as a wall, or stand (not shown) as would be readily apparent to those skilled in the art. As depicted in FIGS. 1 and 2, it can be seen that mannequin 10 is releasably supported by beam 12 in both the secured position, as depicted in FIG. 1 and in the released position as depicted in FIG. 2.

FIG. 3 is a close-up side view of mechanism 14 in the secured position of FIG. 1. Housing 16 is rigidly affixed to inner cavity 19 of mannequin 10 (see FIG. 1). Mechanism 14 includes upper portion 30 rotatably connected to lower portion 32 for rotation about axis 34 defined by bolt 36. This enables upper portion 30 to rotate about lower portion 32 in the direction of arrows 38. As can be seen in FIG. 1 bolt 36 is connected at each end of bolt 36 to opposed side plates 44 of housing 16. Bolt 36 supports upper portion 30 with respect to lower portion 32 and enables rotation thereby rotatably about axis 34 in the direction of arrows 38. Lower portion 32 is fixed in place, being rigidly connected to cone member 58 for rotation therewith as is described below.

Figure 4:
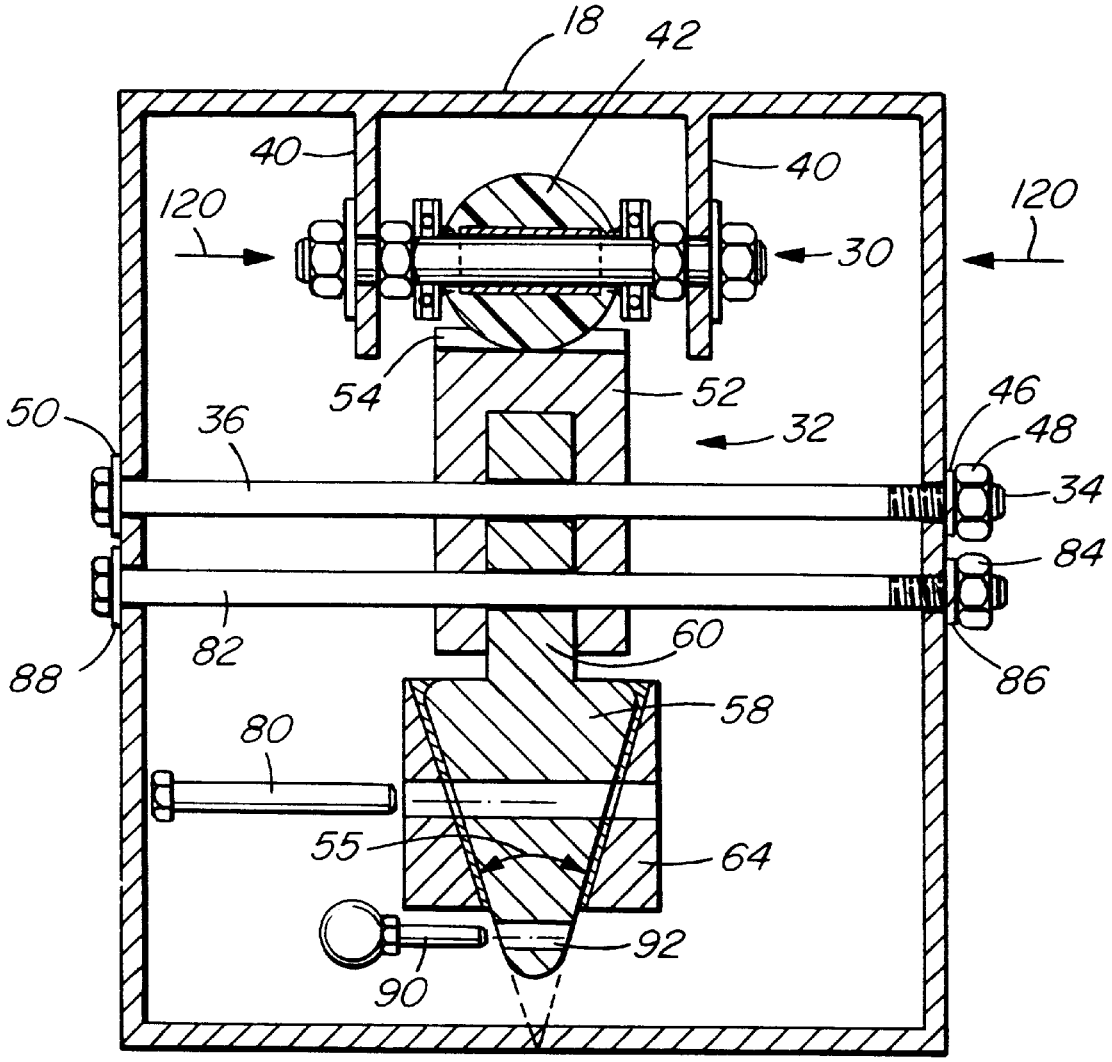
FIG. 4 is a close-up front view of the ball and cam mounting and release mechanism of the embodiment of FIG. 1, showing a non-compressed ball.

Referring to FIG. 4, upper portion 30 includes a pair of parallel opposed ball mounting support flanges 40 which extend downwardly from top plate 18. Resiliently deformable ball 42 is connected to and supported by flanges 40 for rotation of ball 42 about its axis, as described in greater detail with respect to FIGS. 5 and 6 described later.

Bolt 36 extends through and is attached to side plates 44 of housing 16. Bolt 36 includes lock washer 47 and nut 48 at one end, and washer 50 and the other end to securely attach lower portion 32 to housing 16. As housing 16 is rigidly attached to mannequin 10 (FIG. 1), this rotatably attaches mannequin 10 to lower portion 32.

Still referring to FIG. 3, lower portion 32 includes cam support member 52 with a pair of cams 54 in parallel spaced opposed relationship with respect to one another connected to an upper surface of cam support member 52. Cams 54 form indented portion 56 between cams 54 for receiving a surface of ball 42, when mechanism 14 is in the secured position. Ball 42, a resiliently deformable sphere, resting in the indented portion 56 releasably secures upper portion 30 with respect to lower portion 32, and thereby secures mannequin 10 to support beam 12 in a secured position.

Cam support member 52 is supported by cone member 58 which includes cone support post 60 extending into an opening in an interior region of cam support member 52. The lower portion of cone member 58 is generally frusto-conically shaped and dimensioned to fit within corresponding frusto-conically shaped opening 62 of cone receiving portion 64. Cone member 58 is rotatable with portion 64 about a vertical axis and may be coated with a friction reducing material such as TEFLON (registered trade-mark). Cone receiving portion 64 includes lateral support flange 24 dimensioned to fit within cavity 26 of support beam 12. Pin 28 may be fastened by means of nut 66, lock washer 68 and flat washer 70 to secure flange 24 within cavity 26 and to support beam 12.

Cone member 58 may be attached to cone receiving portion 64 by means of nut 72 which is connected to threaded end segment 74 located at a lower end of cone member 58. Washer 76 may be interposed between nut 72 and lower face 78 of cone receiving portion 64 to facilitate rotational movement of cone member 58 within opening 62. Rotational movement of cone member 52 within opening 62 may be enhanced by interposing bearing mechanism 57 between portion 64 and washer 76. Alternatively, and as depicted in FIG. 4, pin 90 inserted into opening 92 through a lower section of cone member 58 may be used to attach cone member 58 within opening 62 while permitting rotation of cone member 52 about to longitudinal axis within opening 62.

As well, as depicted in FIGS. 3 and 4 if the user desires, cone member 58 (FIG. 3) may be rigidly secured within opening 62 by means of pin 80 which extends through a portion of cone receiving portion 64, through cone member 58 and then through an opposite section of cone receiving portion 64 to prevent rotational movement of cone member 58 within opening 62.

Figure 9:
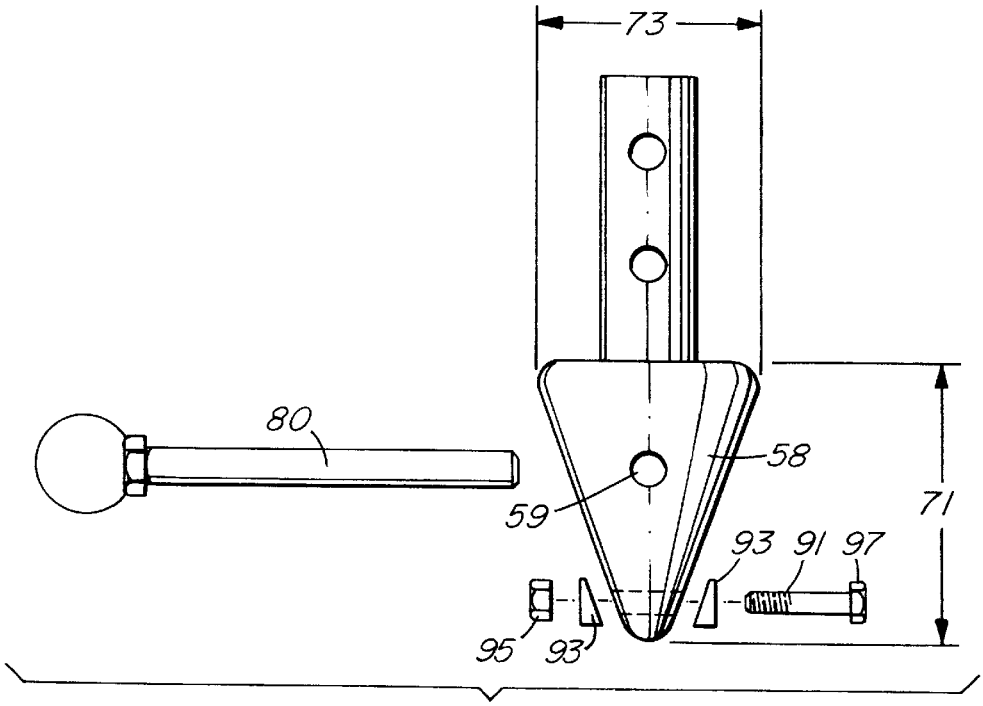
FIG. 9 is a front view of the cone component of the cone mounting of the invention of FIG. 1.
Figure 10:
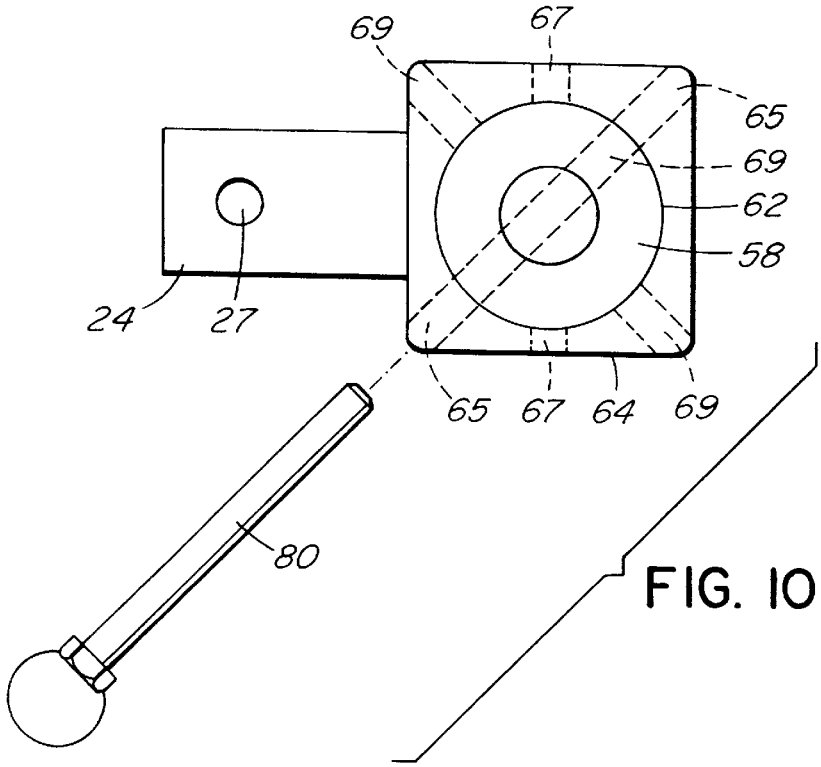
FIG. 10 is a top view of the receptacle component of the cone mounting means of the invention of FIG. 1.

The attachment of mechanism 14 to support beam 12 for rotation in a horizontal plane will be discussed with particular reference to FIGS. 9 and 10. Cone member 58 includes opening 59 extending horizontally through cone member 58.

Bolt 91 may be used as an alternative to pin 90 to secure cone member 58 within cone receiving portion 64 (FIG. 10) spacers 93 are generally triangular in cross section to snugly contact cone member 58 surfaces at one end and nut 95 and bolt head 97 and the other end of spacers 93. Bolt 91 is threaded to receive nut 95 to secure bolt 91 below portion 64. This permits rotation of cone member 58 within portion 64, constrained from upward movement by bolt 91 and nut 95 contacting lower face 99 of portion 64, as best seen in FIG. 4. Referring to FIG. 10, cone receiving portion 64 includes a plurality of openings 65,67 and 69, extending horizontally through receiving portion 64. Openings 65,67 and 69 are aligned horizontally with opening 59 of the cone member 58 (FIG. 9). The openings 59, 65, 67 and 69 are dimensioned to receive pin 80. This permits rigid non-rotational attachment of cone member 58 within opening 62 at several pre-determined orientations of cone member 58 with respect to cone receiving portion 64.

As well, if desired by the user, pin 80 may be removed from openings 59, 65, 67 and 69 to permit free rotational movement of cone member 58 within opening 62. Furthermore, removal of bolt 91 (FIG. 9), pin 90 (FIG. 4) or nut 72 and washer 76 (FIG. 3) will permit removal of cone member 58 from opening 62 upon application of force being applied to mannequin 10, in an upward direction along the surface of cone member 58. This permits removal of mannequin 10 from support beam 12 as a part of a testing or training regime.

This may be desirable if, for example, the training and testing regime involving the removal of mannequin 10 from support beam 12 as discussed in the preceding paragraph, is to be undertaken. If desired by the user mechanism 14 may be fixed in a secured position to prevent rotational movement of upper portion 30 with respect to lower portion 32 by securing bolt 82 (FIG. 4) through cone support post 60. Bolt 82 will prevent rotational movement of lower portion 32 with respect to upper portion 30 of mechanism 14, thereby preventing movement of mannequin 10 from the secured position as depicted in FIG. 1. Bolt 82 extends through an opening journalled through cam support member 52 and cone support post 60. Bolt 82 is attached to side plates 44 by means of nut 84, lock washer 86 and flat washer 88.

It will be appreciated that the length of cone member 58 and the angle of its surface with respect to the horizontal will primarily determine the amount of force required to remove mannequin 10 from support beam 12. In general the objective is to permit removal of mannequin 10 during a martial arts throw by lifting mannequin 10 about one inch combined with a pulling force along a line defined by the outer face of cone member 58 to readily release mannequin 10 permitting the user to throw mannequin 10 to the mat.

Permitting removal of mannequin 10 as described above must be balanced against the need to retain mannequin 10 within portion 64 to provide a secure mount for moves not requiring the removal of mannequin 10, such as those associated with boxing, karate, football, rugby and the like. In order to provide sufficient strength and support of mannequin 10 within beam 12 cone member 58 length 71 of about two to three inches and upper diameter 73 of about 3 inches should be provided. This may vary depending on the type of material used. As well, and again depending on the material used, to provide sufficient strength in bolt 91, bolt 91 should be at least three-eighths to one half inch in length beyond the lower apex of cone member 58. As well the thickness of wall 61 (FIG. 8) of the upper region of portion 64 should be at least ½ inch.

With the above parameters of cone member 58 selected, I have determined that the optimum cone angle 55 (FIG. 4) of cone member 58 and portion 64 is 38 degrees. A preferred range of cone angles 55 is between 25 and 80 degrees. An even more preferred range of angles 55 is between 35 and 40 degrees. It has been found that this provides sufficient mass of cone member 58 within receiving portion 64 to rotatably secure mannequin 10 within support beam 12 when in use while allowing users to perform martial arts throws without undue difficulties in removing cone member 58 from receiving portion 64.

Figure 5:
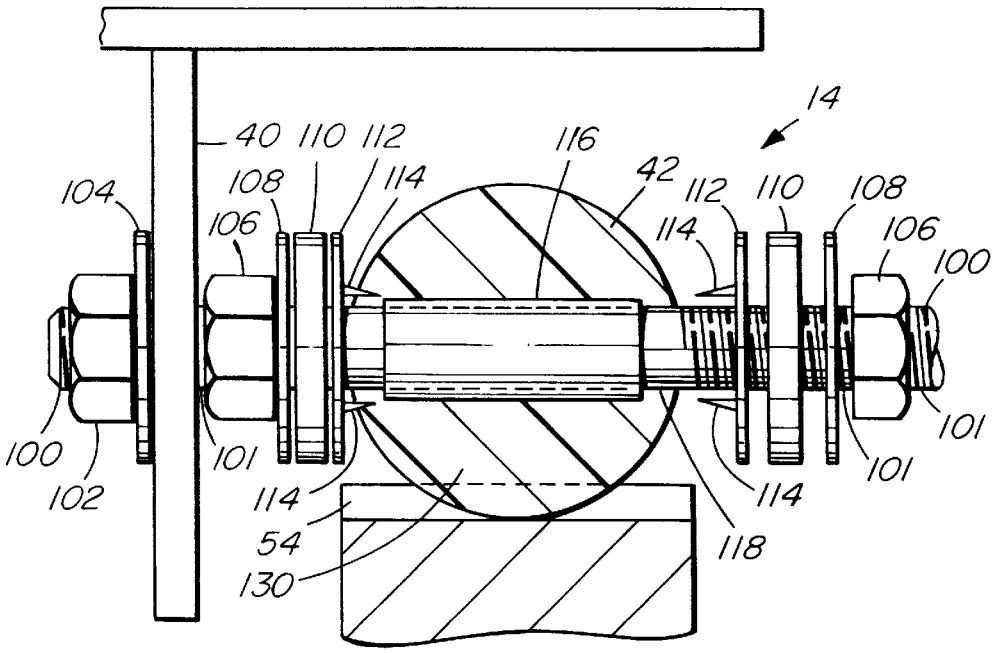
FIG. 5 is a close-up front view of the ball and cam mounting and release mechanism with certain components separated, of the invention depicted in FIG. 1.
Figure 6:
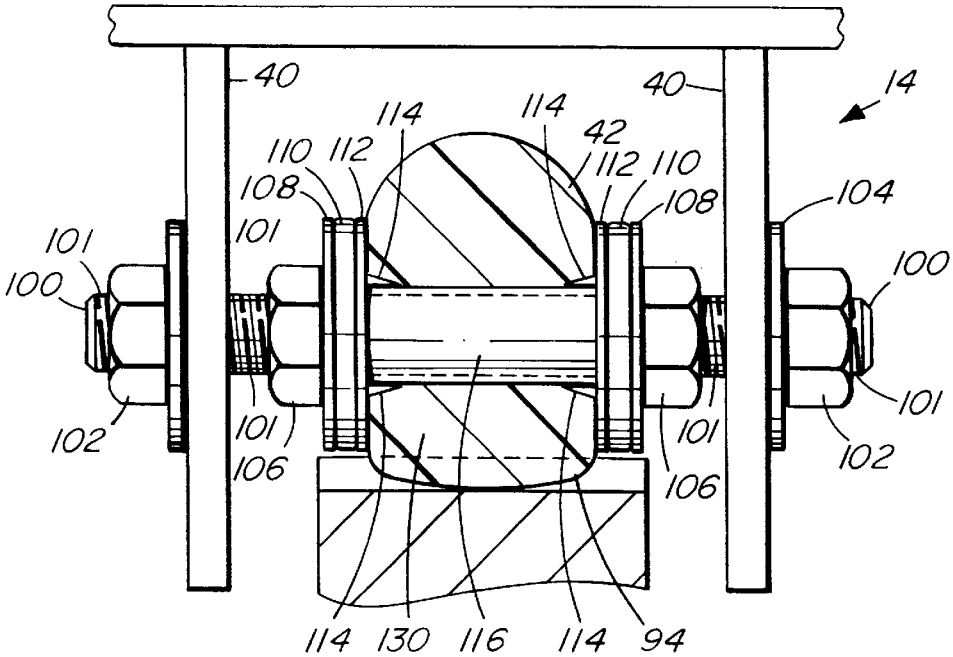
FIG. 6 is a close-up front view of the ball and cam mounting and release mechanism of the invention of FIG. 1, showing a fully compressed ball.

Referring to FIGS. 5 and 6, the means for adjusting the contact force between ball 42 and cams 54 will now be discussed. FIG. 5 depicts a portion of ball and cam mechanism 14 with ball 42 in a non-compressed position which permits movement of ball 42 past cams 54 using the least or threshold force to move mannequin 10 to the released position shown in FIG. 2.

FIG. 6 depicts a portion of mechanism 14 with ball 42 in a compressed position with an increased density of compressed ball 42 material in indented portion 56 (FIG. 3) contacting cam 54 which results in more force required to move ball 42 past cam 54 in order to move mannequin 10 into the released position depicted in FIG. 2.

Ball 42 is rotatably attached to flanges 40, as best seen in FIG. 6. However for ease of reference and to best describe the inter workings of the attachment of ball 42 to flanges 40, FIG. 5 shows several components in a separated view, although it should be appreciated that FIG. 6 discloses positioning of these components when in use.

Referring to FIG. 6, longitudinal axle 100 extends laterally through coaxial openings in flanges 40. Axle 100 includes threads 101 at each end portion of axle 100. Nuts 102 threadingly engage threads 101 of opposite ends of axle 100. A pair of flat washers 104 are interposed between respective inner faces of nuts 102 and outer faces of flanges 40. Nuts 102 are tightened to rigidly secure axle 100 to flanges 40.

A second pair of nuts 106 threadingly engage threads 101 of axle 100 with nuts 106 located in the region between flanges 40 on opposite sides of ball 42. A pair of flat washers 108 are positioned on axle 100 adjacent respective inner faces of nuts 106. A pair of bearing assemblies 110 are positioned on axle 100 adjacent respective inner faces of washers 108.

A pair of inner control washers 112 are positioned on axle 100 adjacent inner faces of assembly 110. Assembly 110 permits rotation of washer 112 in relation to washer 108 which remains generally stationary, upon rotation of ball 42. Control washers 112 include a cylindrical limiter 114 extending is laterally from the inner side of washers 112.

A longitudinal cylindrical sizing bushing 116 is positioned about axle 100 and dimensioned such that bushing 116 is free to rotate about axle 100. Bushing 116 is further dimensioned to fit within the interior opening formed inside each cylindrical limiter 114. Sizing bushing 116 is dimensioned in length to provide a stop preventing further inward movement of washers 112 beyond a predetermined limit of compression on ball 42.

Resiliently deformable ball 42 includes opening 118 journalled through the center region of ball 42 of diameter sufficient to permit insertion of sizing bushing 116 through opening 118. The non-compressed diameter of ball 42, as depicted in FIG. 5, is such that the ends of bushing 116 are contained within limiters 114 when washers 112 are positioned adjacent to ball 42. This causes limiters 114 to prevent lateral movement of ball 42 while permitting rotation of bushing 116 about axle 100, assisted by bearing assembly 110.

Figure 7:
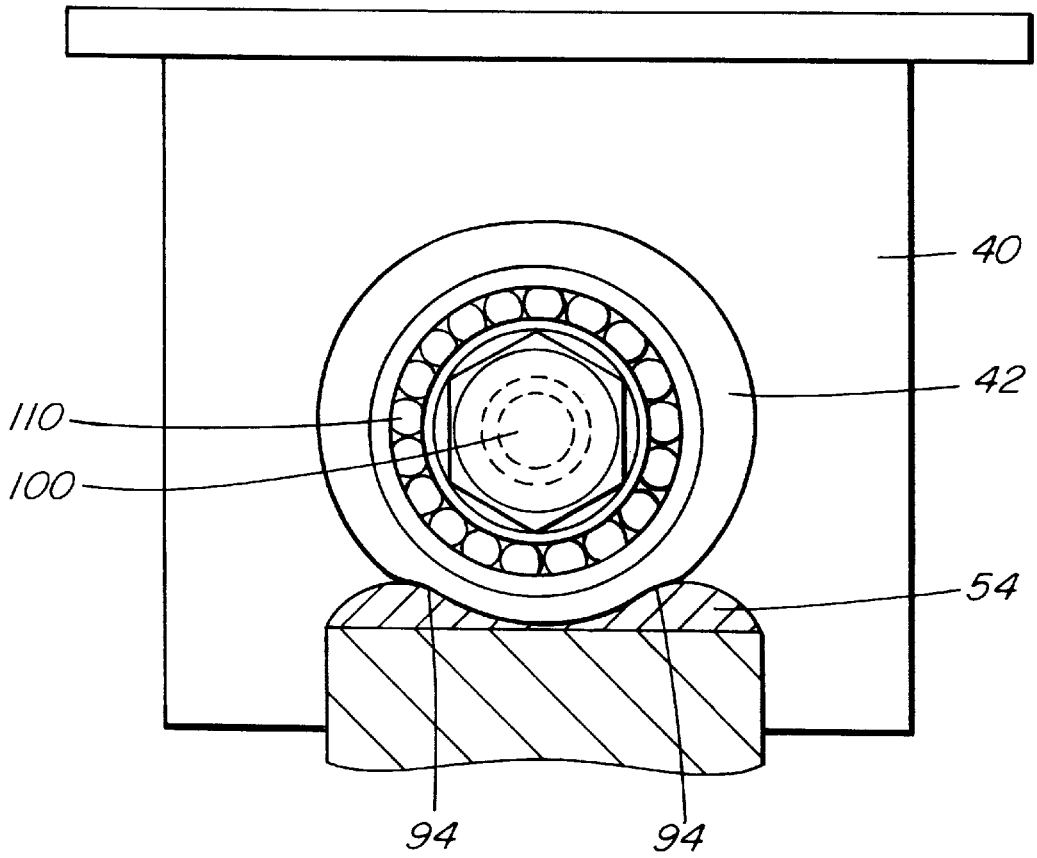
FIG. 7 is a close-up side view of the ball and cam mounting and release mechanism of the invention of FIG. 1 showing a compressed ball.

Referring to FIG. 6, nuts 106 may be rotated about thread 101 of axle 100 towards one another thereby decreasing the distance between washers 112. This causes force to be directed on ball 42 in opposite directions parallel to the longitudinal axis of axle 100, in the direction of arrows 120 (FIG. 4). The application of force in those directions deforms the periphery of ball 42 which causes an increase of mass of ball 42 to be forced into indented portion 56 between cams 54 (as best seen in FIG. 7). As a result there is an increase in ball 42 mass at the contact area 94 (FIGS. 6 and 7) which causes an increase in force required in order to move ball 42 past cam 54 to move mechanism 14 to the released position depicted in FIG. 2.

FIG. 6 depicts ball 42 in its fully compressed position with space between the ends of bushing 116 and the inner faces of washers 112. Bushing 116 prevents further inner movement of washers 112 towards each other preventing further compression of ball 42 past the point depicted in FIG. 6. This provides substantially the maximum mass of ball 42 within indented portion 56 as further turning of nuts 106 towards each other will cause the ends of bushing 116 to contact inner faces of washers 112 thereby preventing further inner movement of bolts 106 and further compression of ball 42.

FIG. 7 is a side view depicting ball 42 in a compressed position with an area of increased mass of ball 42 within indented portion 56 and contacting cams 54. The area of contact between ball 42 and cams 54 constitutes the contact area. The contact area increases with an increase in compression of ball 42 by nuts 106, as depicted in FIG. 6, and decreases with a corresponding decrease in compression on ball 42 by nuts 106. Increased compression on ball 42 in the direction of arrows 120 (FIG. 4), and the corresponding increased mass 130 of ball 42 contacting cams 54 results in a higher force required to release upper portion 30 from lower portion 32 to permit rotation of upper portion 30 about axis 34.

Figure 8:
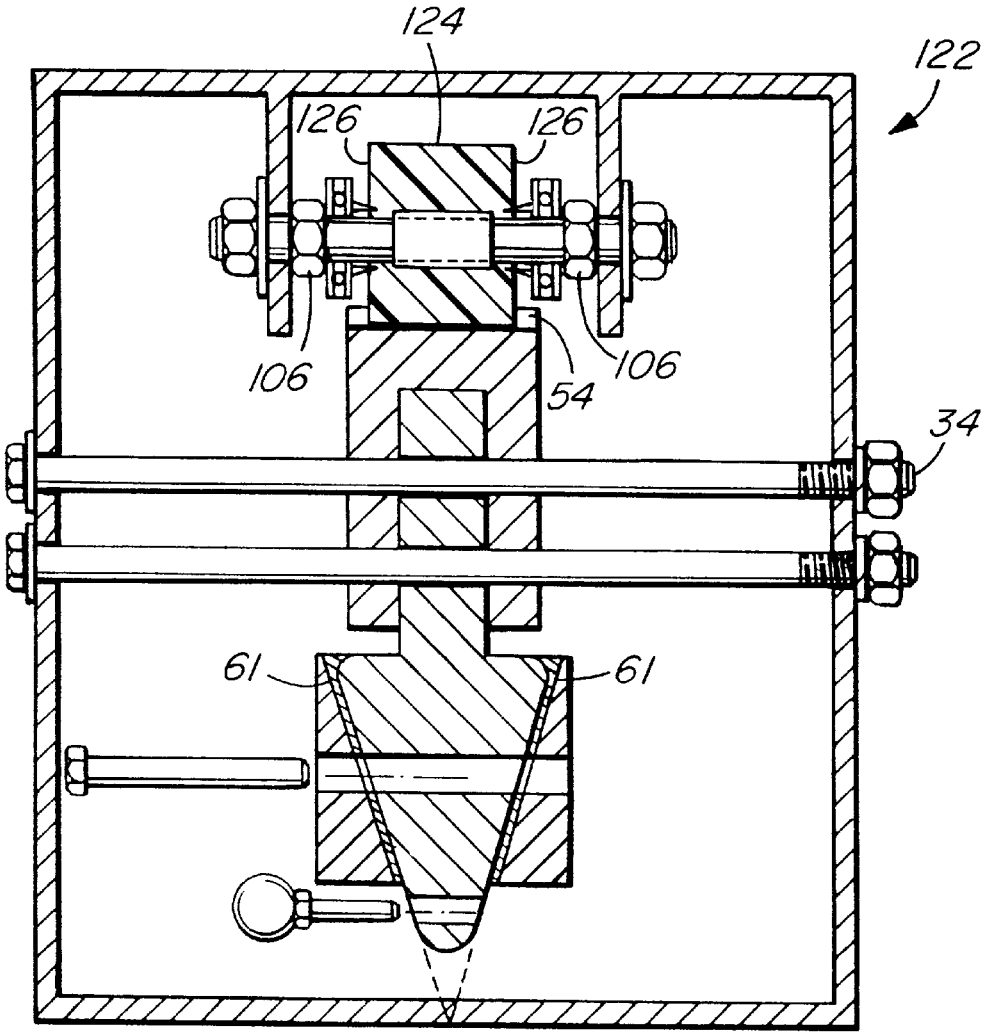
FIG. 8 is a front view of the roller and cam alternate embodiment of the invention of FIG. 1.

FIG. 8 depicts an alternate mechanism 122 similar to mechanism 14 except that cylindrically shaped ball 124 replaces spherical ball 42 of mechanism 14. Cylindrical ball 124 may be compressed in a similar manner compared to spherical ball 42 by rotating nuts 106 inwardly forcing the ends 126 of cylindrical ball 124 together. This increases the circumference of cylindrical ball 124 in a central region, thereby increasing the mass of the cylindrical ball at a contact area where it contacts cam 54. Increase compression on cylindrical ball 124 in this manner increases the force required to overcome the contact force between cylindrical ball 124 and cam 54 permits cylindrical ball 124 to pass beyond cam 54 and rotate about axis 34.

Removable Cams

Figure 11:
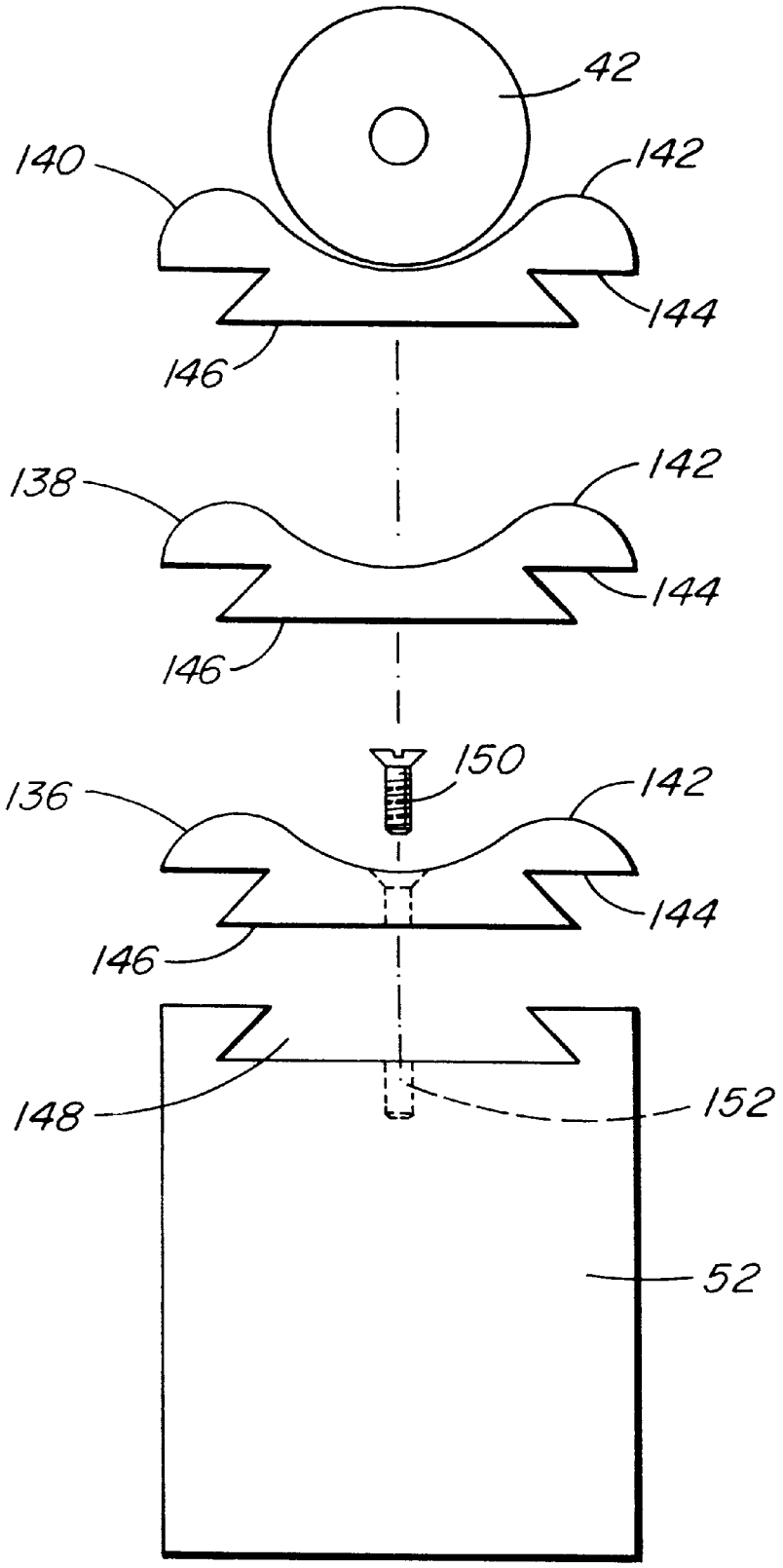
FIG. 11 is a side view of a removable cam of the invention of FIG. 1, depicting three alternate cam height assemblies.

The removable cam option of the subject invention will now be discussed with reference to FIGS. 11 and 12. FIG. 11 depicts three alternate interchangeable cam pair assemblies, namely low profile assembly 136, is intermediate profile assembly 138 and high profile assembly 140 all representing a central area of cam 54. The distance between the apexes 142 of each pair of cams 54 in relation to base face 144 differs in each of assemblies 136, 138 and 140. Assembly 136 has the smallest distance between apex 142 and face 144 while assembly 140 has the greatest distance between apex 142 and face 144. The distance between apex 142 and face 144 of assembly 138 is intermediate between those distances of assemblies 136 and 140. This allows users to selectively choose the lowest or threshold force required to release ball 42 past cam 54 to move mechanism 14 to the release position depicted in FIG. 2 when ball 42 is in its completely non-compressed state. As between the three assemblies 136, 138 and 140, used of assembly 140 will result in the greatest base or threshold force required to release ball 42 from cam 54 when ball 42 is in its fully non-compressed state. Assembly 136, inserted into cam support member 52 will result in the least force requirement of the three assemblies 136, 138 and 140 in order to release ball 42 from cam 54.

Assemblies 136, 138 and 140 are interchangeable and are selectively inserted into cam support member 52 as desired by users by sliding engagement fit of flange 146 of identical size in each of assemblies 136, 138 and 140 which extend below as a part of assemblies 136, 138 and 140. Flange 146 is dimensioned to slidingly engage within cavity 148 in the upper face of member 52. Screw 150 which threadingly engages hole 152 through an opening (not shown) in assemblies 136, 138 and 140 is used to secure those assemblies in place when flange 146 is in cavity 148. Assemblies 136, 138 and 140 are slidable in the direction of arrow 154 (FIG. 12) into cavity 148. Selection between assemblies 136, 138 and 140 will permit users to vary the least or threshold force to move an uncompressed ball 42 past cams 54 and vary the corresponding increased force as ball 42 is compressed and forced over the selected assembly 136, 138 and 140.

Multicam Rotational System

The multicam rotational system 160 will be discussed with reference to FIGS. 13 and 14. Multicam rotational system 160 may be used to test users strength in performing rotational movement or to train users in strengthening appropriate muscle groups used in rotational movement.

Figure 14:
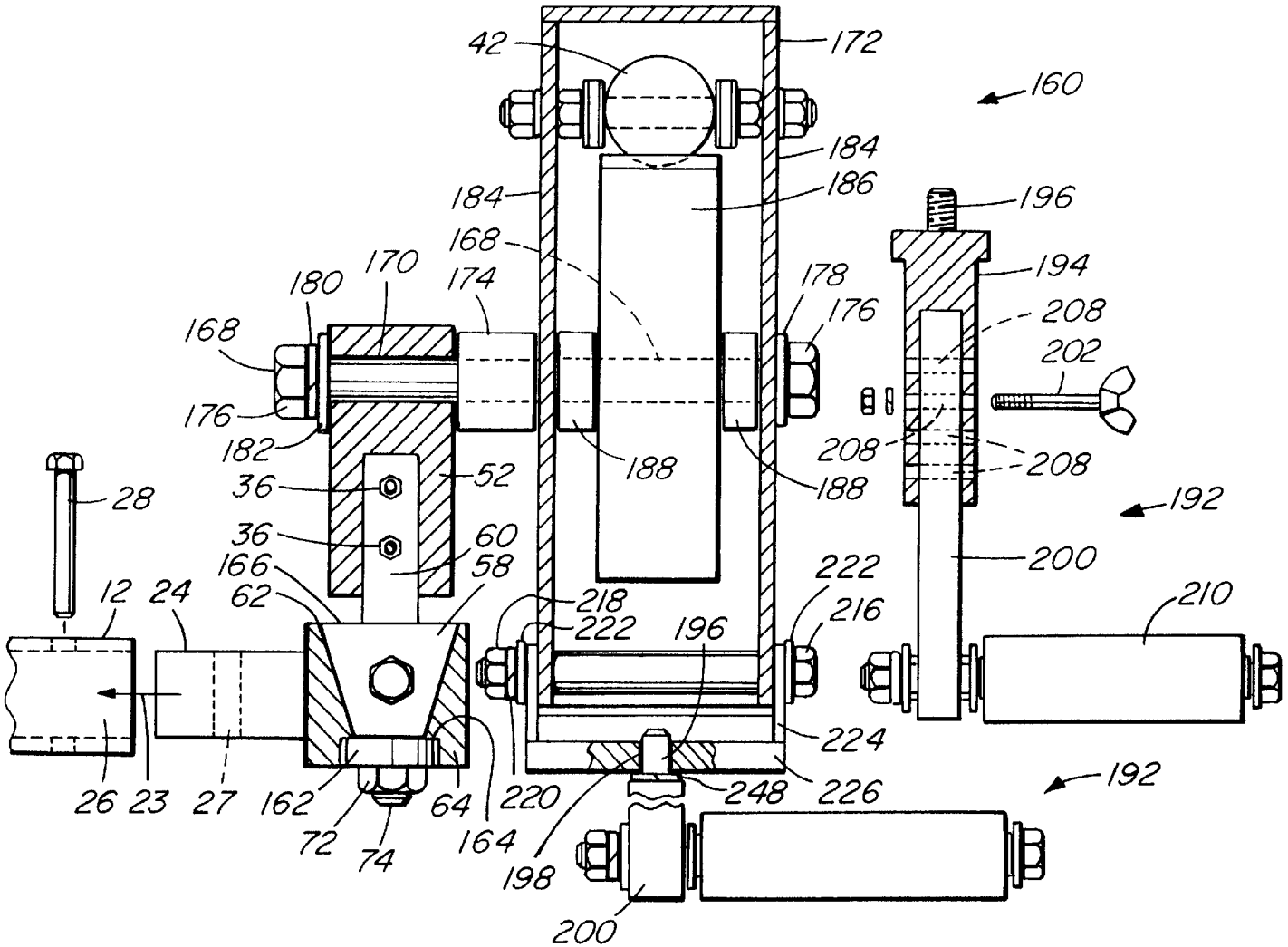
FIG. 14 is a front view of the embodiment of FIG. 13.

Referring to FIG. 14 system 160 maybe mounted to a support structure, in this case support beam 12 as depicted in FIG. 1 with support flange 24 sliding into cavity 26 in the direction of arrow 23. Pin 28 engaging holes 25 and 27 extending horizontally through flange 24 may be used to secure flange 24 within cavity 26 thereby securing system 160 to support beam 12. In turn, support beam 12 may be rigidly attached to a wall or other support structure such as a series of legs on a floor. Alternatively support beam 12 may be a component of an arm of a testing and training machine such as that disclosed in U.S. Pat. Nos. 4,951,943, 5,050,872 and 5,152,733.

Flange 24 is connected to cone receiving portion 64 which may be identical to that as depicted in FIGS. 3 or 4. Cone receiving portion 64 includes conically shaped opening 62 for receiving cone member 58 therein. Cone member 58 is rotatable within opening 62 and may be secured to portion 64 by means of nut 72 on threaded end segment 74 attached to cone member 58. In order to facilitate rotation of cone member 58 within opening 62 bearing assembly 162 may be interposed between nut 72 and a lower face 164 of cone member 58. Assembly 162 is similar to bearing assembly 110 interposed between washers similar to washers 108.

Figure 12:
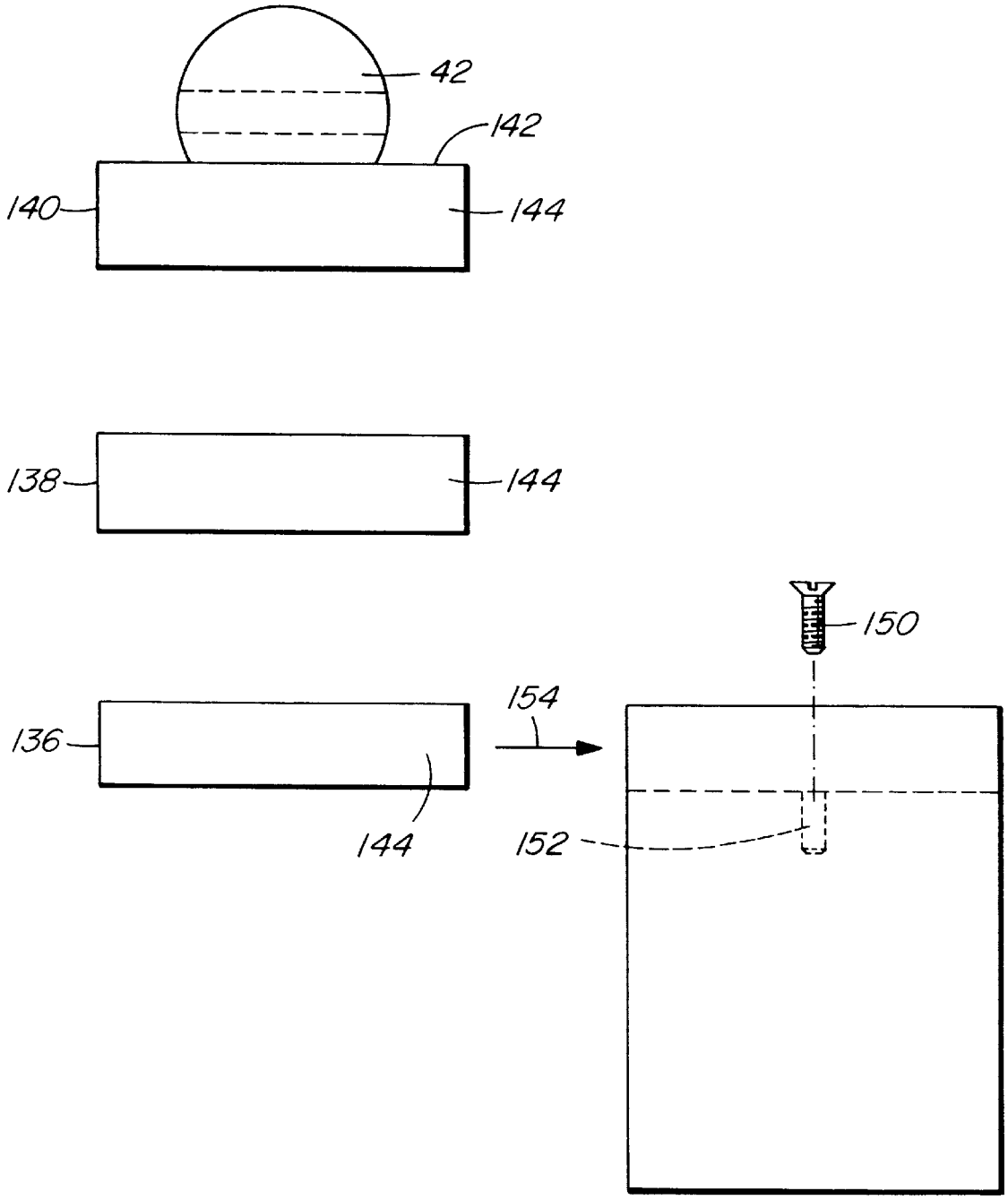
FIG. 12 is a front view of a removable cam of the invention of FIG. 1, depicting the three alternate cam height assemblies of FIG. 11.

While not shown in FIG. 12, it should be appreciated that cone member 58 and cone receiving portion 64 may include means for adjusting the position of system 160 with respect to beam 12. This could include opening 59 in cone member 58 and openings 65, 67 and 69 in portion 64, as depicted in FIG. 9.

Cone support post 60 extends upwardly from larger diameter end 166 of cone member 58. Cam support member 52 is rigidly connected to post 60 by means of a pair of bolts 36. Large diameter bolt 168 extends through opening 170 journalled through support member 52 in a direction perpendicular to that of bolts 36. Metal support frame 172 is rotatably attached to bolt 168 for axial rotation about bolt 168. Spacer 174 is interposed on bolt 168 between cam support member 52 and support frame 172 to permit clearance of elements attached to support frame 172 and cone receiving portion 64. Nut 176 with washer 178 adjacent thereto is threadingly engaged to bolt 168. If desired a locking nut or lock washer may be utilized to secure nut 176 to bolt 168. In this embodiment lock washer 180 is interposed between bolt 168 head and washer 182 to prevent detachment of nut 176 from bolt 168. Resiliently deformable ball 42 is rotatably connected between sides 184 of support frame 172. Ball 42 is attached to sides 184 in the manner similar to that of the attachment of ball 42 to flanges 40 and in a manner which permits compression of ball 42 as previously described and as depicted in FIG. 6.

Multiple cam member 186 is rigidly attached to bolt 168 with spacers 188 interposed on bolt 168 between side walls 184 and cam member 186. Cam member 186 includes a plurality of cam apexes 190, in this case five, and a plurality of indented portions 56, also five in this case, as seen in FIG. 13.

Handle assembly 192 is attached to an outer region of support frame 172. Handle assembly 192 includes handle receiving member 194 connected to upper pin 196 which is journalled to snugly fit within opening 198 of support frame 172. Adjustable extender 200 is attached to member 194 by means of thumb screw 202, lock washer 204 and bolt 206. A plurality of openings 208 which are dimensioned to accept screw 202 may be selected to increase the length of extender 200 with respect to member 194 thereby increasing the radius of rotation of handle assembly 192. Rotatable gripping portion 210 is rotatably attached to extender 200 to permit manual gripping by a user to rotate support frame 172, and thereby ball 42, about bolt 176 from one indented portion 56 to an adjacent indented portion 56 in rotational motion about multiple cam member 186 (see FIG. 13).

Figure 13:
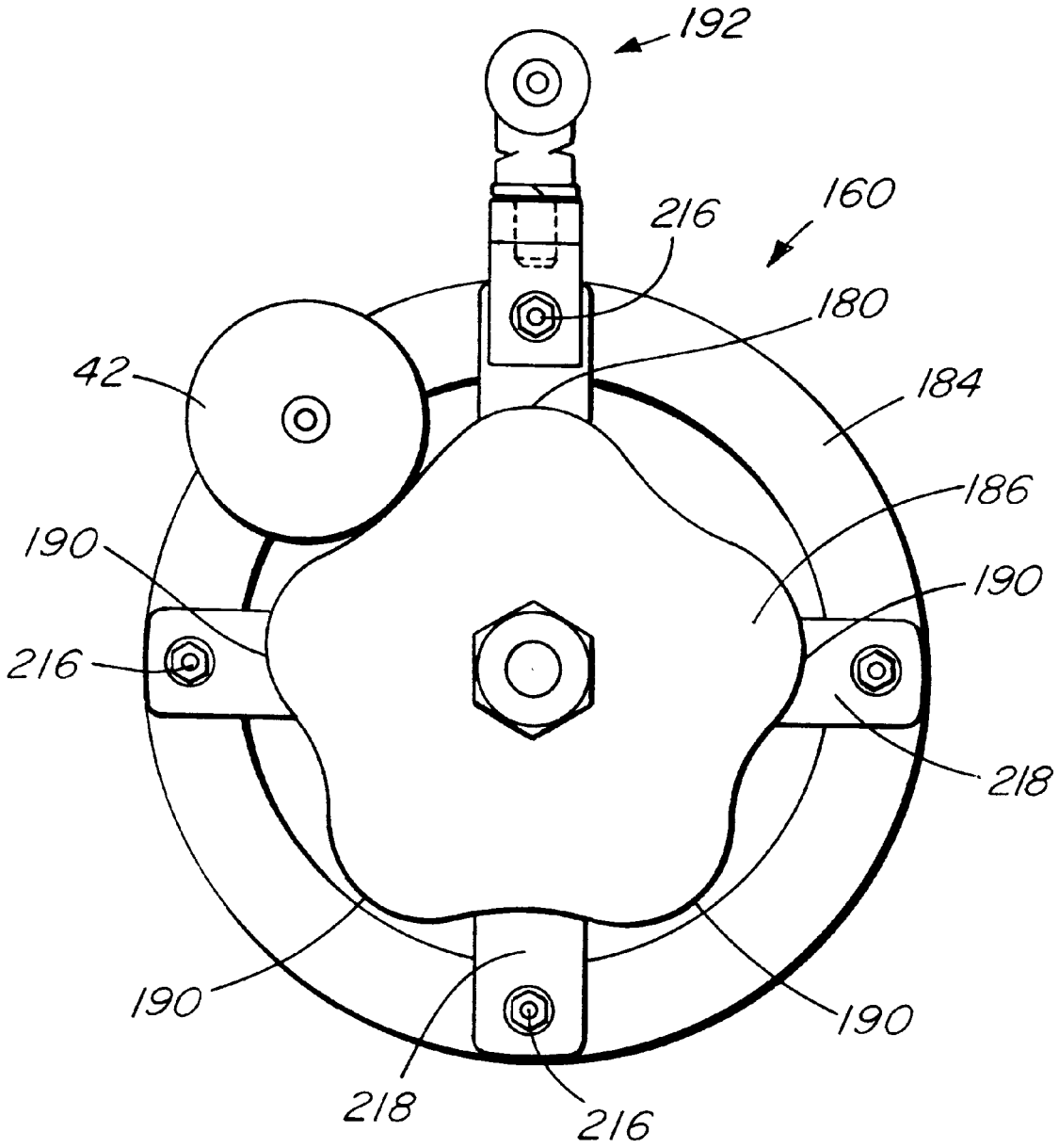
FIG. 13 is a side view of an alternate embodiment of the invention showing a multi-cam and ball system.

Sides 184 of support frame 172 are held in opposed parallel spaced relationship by means of four bolts 216 in spaced relationship about sides 184, as best seen in FIG. 13. Nut 218 and lock washer 220 are used to secure bolt 216. Flat washers 222 are interposed at each end of bolt 216. Handle securing member 224 extends from each end of bolt 216 adjacent respective sides 184. Cross member 226 includes opening 198 for receiving pin 196. Lock washer 248 prevents inadvertent removal of pin 196 from opening 198.

I claim:

1. An attachment member for attaching an object to a support comprising:

(a) a support end for supporting the member and the object;

(b) an object attachment end for attaching the object to the member;

(c) connecting means for connecting the support end and object attachment end, comprising:

(i) a resiliently deformable first contact member having a contact area connected to one of the support end and object attachment end pivotable with respect to the other of the support end and object attachment end about a first pivot axis, the first contact member deformable about its periphery to increase and decrease the mass of the first contact member at the contact area;

(ii) an adjuster for increasing and decreasing the first contact member mass at the contact area; and (iii) a second contact member connected to the other of the support end and attachment end contacting the contact area to releasably secure the support end to the attachment end;

whereby the force required to overcome the contact force between the first and second contact members, permitting the first contact member to pass beyond the second contact member and rotate about the first pivot axis increases and decreases with a corresponding increase and decrease in the mass of the first contact member at the contact area.

2. The member as described in claim 1 wherein the mass of the first contact member at the contact area is increased or decreased as force is increased or decreased on the first contact member in first and second directions substantially perpendicular to the plane defined by the contact area and wherein the adjuster comprises a force applicator for increasing and decreasing the force on the first contact member in the first and second directions.

3. The member as described in claim 1 wherein the first contact member is cylindrically shaped with a pair of end faces connected by a perpendicular wall, a portion of the perpendicular wall comprising the contact area.

4. The member as described in claim 1 wherein the first contact member is spherically shaped with a portion of the outer periphery wall of the first contact member comprising the contact area.

5. The member as described in claim 4 wherein the first and second directions pass through the center point of the first contact member.

6. The member as described in claim 1 wherein the first contact member is rotatably connected to one of the support end and object attachment end.

7. The member as described in claim 3 wherein the mass of the first contact member at the contact area is increased or decreased as force is increased or decreased on one or both end faces in directions perpendicular to the plane of those faces.

8. The member as described in claim 7 wherein the directions passes through the axis of the first contact member.

9. The member as described in claim 8 wherein the directions are toward one another.

10. The member as described in claim 2 wherein the first and second directions are towards one another and towards the center of the first contact member.

11. The member as described in claim 1 wherein the second contact member comprises a pair of parallel opposed upstanding members forming an indented portion therebetween for receiving the first contact member whereby the first contact member may be moved selectively over either one of the pair of second contact members to move the first contact member beyond that second contact member.

12. The member as described in claim 1 wherein the second contact member comprises a cam having a generally curved surface with an extended central area.

13. The attachment as described in claim 1 wherein the one of the support end and object attachment end connected to the first contact member, compresses a pair of opposed support members pivotally attached to the other of the support end and object attachment end to permit pivotable movement of the one of the support end and object attachment end connected to the first contact member about the first pivot axis.

14. The member as described in claim 1 where the mass of the first contact member at the contact area is increased or decreased as force is increased or decreased on the first contact member in first and second directions substantially perpendicular to a plane defined by the contact area and wherein the adjuster comprises a force applicator for increasing and decreasing the force on the first contact member in the first and second directions.

15. The attachment as described in claim 12 wherein the extended central area comprises adjustment means for adjusting the height of the extended central area thereby adjusting the amount of the extended central area contacting the first contact area.

16. The member as described in claim 15 wherein the second contact member comprises a plurality of interchangeable central areas, each central area of a differing height and attachable to the second contact member to adjust the amount of the second contact member contacting the first contact area.

17. A releasable mounting member for rotatably and releasably mounting an object to a support, comprising:

(i) conically shaped extension member connected to the object having a longitudinal axis;

(ii) an extension support member connected to the support, comprising conically shaped extension housing having a longitudinal axis, the housing dimensioned to hold the extension member in the housing and to permit the extension member to rotate about the housing longitudinal axis, the extension member being releasable from the housing upon application of force on the extension member in a direction substantially away from the extension support member.

18. The member as described in claim 17 wherein the larger diameter end of the extension support member and housing faces upwardly the lesser diameter end faces downwardly and wherein a upward force substantially in the direction along the side of the extension member is required to be applied on the extension member to release the extension member from the housing.

19. The member as described in claim 18 wherein the cone angle of the outer surface of the extension in relation to the axis of the extension is between 25 and 80 degrees.

20. The member as described in claim 18 wherein the cone angle of the outer surface of the extension in relation to the axis of the extension is between 35 and 40 degrees.

21. The member as described in claim 18 wherein the cone angle of the outer surface of the extension in relation to the axis of the extension is about 38 degrees.

22. The member as described in claim 18 wherein the length of the extension support member and housing are from about 2 inches to about 3 inches.

23. The member as described in claim 22 wherein the length of the extension and housing are about 2.5 inches.

24. A testing and training apparatus comprising:

(a) a resiliently deformable first contact member having a contact area, the first contact member deformable about its periphery to increase and decrease the mass of the first contact member at the first contact area;

(b) a rotatable frame member connected to the first contact member and rotatable about an axis of rotation;

(c) an adjuster for increasing and decreasing the first contact member mass at the contact area;

(d) a second contact member comprising a plurality of apexes for contacting the contact area, the apexes in concentric circular alignment about the axis of rotation of the frame member and in alignment with the contact area;

whereby the force required to overcome the contact force between the first contact member and each apex, permitting the first contact member to pass beyond each apex and rotate to the next aligned apex increases and decreases with a corresponding increase and decrease in the mass of the first contact member at the contact area.

25. The apparatus as described in claim 24 wherein the first contact member is spherical in shape.

26. The apparatus as described in claim 24 wherein the first contact member is cylindrical in shape.

27. The apparatus as described in claim 24 wherein the second contact member comprises apex adjusting means for adjusting the height of the apexes to adjust the force required to overcome the contact force between the first contact member and each apex.

28. The apparatus as described in claim 24 wherein the second contact member further comprises a plurality of indented portions, each indented portion located between adjacent apexes, the indented portions forming a seat to contain the first contact member between adjacent apexes.

* * * * *